US005197911A

United States Patent [19]

Wilson

[11] Patent Number: 5,197,911

[45] Date of Patent: Mar. 30, 1993

[54] AUTOMATIC RELEASE MECHANISM

[75] Inventor: Robert F. Wilson, Vancouver, Canada

[73] Assignee: MPR Teltech Ltd., Burnaby, Canada

[21] Appl. No.: 750,583

[22] Filed: Aug. 28, 1991

[51] Int. Cl.[5] ..... B63B 22/14

[52] U.S. Cl. ..... 441/10

[58] Field of Search ..... 114/367; 441/7-10, 441/32, 33, 42

[56] References Cited

U.S. PATENT DOCUMENTS 2,360,848 10/1944 Bryant .
2,839,767 6/1958 Sieverts .
3,075,208 1/1963 Mercer et al. .
4,981,453 1/1991 Krishan et al. ..... 441/10

FOREIGN PATENT DOCUMENTS 0198805 3/1986 European Pat. Off. .
61-1619 1/1986 Japan .

*Primary Examiner*—Jesus D. Sotelo
*Attorney, Agent, or Firm*—Shlesinger Arkwright & Garvey

[57] ABSTRACT

A release mechanism for a buoyant object which includes a strap enclosing the object, an engaging mechanism for releasably engaging ends of said strap and an actuator for actuating the release of the ends of said strap in response to an increase in water pressure to a predetermined level.

11 Claims, 3 Drawing Sheets

AUTOMATIC RELEASE MECHANISM

The present invention relates to an automatic release mechanism for retaining and automatically releasing safety equipment such as lifeboats, radio beacons and the like in an emergency.

BACKGROUND

Conventional mechanisms for retaining and automatically releasing safety equipment at sea includes a rope or strap wound around the equipment with one end affixed to a support and the other fastened to a release mechanism. Upon a trigger signal from a sensing mechanism such as a diaphragm sealing a closed chamber, the release mechanism releases or cuts one end of the strap. The equipment then is designed to float free of the craft. Problems may be experienced, however, with devices which use a cutting mechanism for the release of equipment, such as European Patent Office Publication No. 0 198 805 by Hermansson. If such a mechanism cuts through one end of the strap or rope, it may fail to cut cleanly, or once cut, the strap or rope may become caught in the mechanism itself. Such a possibility is understandable considering that the end being cut must be held securely for the cutting procedure. Alternatively, an external object such as a line or other object may lie across the strap or cord near the end to be released preventing the equipment from being freed.

Where release mechanisms are used for the automatic release of lifeboats or radio beacons, it is desirable for the release mechanism to be sensitive to an increase in water pressure, usually to a predetermined level, but immune to increases in air pressure, such as those caused by increases in temperature. Increases in air pressure may cause accidental activation of a release mechanism where the mechanism comprises a diaphragm separating two air chambers, and provisions have not been made for the equalization of the external air pressure with the internal air chamber pressure. U.S. Pat. No. 2,839,767 of Sieverts and U.S Pat. No. 3,075,208 of Mercer and Dewar describe sealed air chambers which are sensitive to fluctuations in air pressure occasioned by temperature changes, and hence, are unreliable for uses where only water pressure sensitivity is desired.

Japanese Patent No. 61-16191 describes a release mechanism which is immune to changes in temperature and air pressure, but may become jammed as only one end of its strap is released. U.S. Pat. No. 2,360,848 of Bryant also describes a release mechanism sensitive to changes in water pressure while immune to changes in air pressure; however, this mechanism may fail to release due to undesired frictional forces. Bryant's invention describes a configuration where two plate-like sections directly exert undesired biasing forces against a pin on which release is dependent. These biasing forces cause sufficient friction that the pin is either unable to reliably activate the release mechanism, or delays release until a water pressure greater than the predetermined level is attained. Both U.S. Pat. Nos. 2,839,767 and 3,075,208 seek to avoid these undesired biasing forces, but are sensitive to air pressure changes.

Accordingly, it is an object of the present invention to provide an improved, more reliable automatic release mechanism which is sensitive to a change in water pressure to a predetermined level, but immune to changes in air pressure or temperature. It is a further object of the invention to provide a release mechanism which completely releases a strap or cord from the support object.

SUMMARY OF THE INVENTION

The invention provides for an emergency position indicating radio beacon locator consisting of a buoy equipped with a radio transmitter and strobe light, associated brackets for mounting the locator onto horizontal or vertical surfaces, and a release mechanism which is sensitive to an increase in water pressure to a predetermined level.

The release mechanism may be used for any type of buoyant object, and consists of a strap enclosing the object, means for releasably engaging both ends of the strap, and means for actuating the engaging means in response to an increase in water pressure. By releasably engaging both ends of the strap a more reliable release of the buoyant object may be effected than would be the case if only one end were released.

The engaging means may be a pair of pins, which are movable from a locked position to a release position by a constant biasing force. In the locked position, the pins are inserted through holes in the ends of the strap while in the release position, the pins are withdrawn from these holes. The actuating means may include a spring-loaded release plate which is slidable between a locked position and a release position. When the release plate is in the locked position, the pins are also in the locked position, as both sides of the release plate prevent the pins from being withdrawn form the holes in the ends of the strap. In the release position, the pins are free to move allowing the biasing force to withdraw the pins from the holes. The biasing force consists of a heavy spring mounted on each pin and provides a biasing force directed away from the holes in the ends of the straps, so as to enable the removal of the pins from the holes.

A pressure sensor having a piston rod movable from an engaged position to a release position releases the release plate in response to an increase in external water pressure beyond a predetermined level. The release plate may have a piston rod hole into which the piston rod may be inserted. The removal of the piston rod from the rod hole allows the release plate to slide in response to a constant biasing force provided by a spring. When the piston rod is inserted into the rod hole, the release plate is prevented from sliding out of the locked position, and the pair of pins are inserted into their respective strap holes. When the piston rod is withdrawn from the rod hole, the release plate slides into the release position in which the pins are withdrawn from their respective strap holes.

The pair of pins may preferably be aligned and movable in directions opposite to one another. By arranging for the piston rod to simply hold a release plate in place against a constant biasing force there is no substantial side thrust on the piston rod other than the small constant biasing force on the plate. Moreover, by arranging for the pins to be aligned and biased towards the release plate on opposite sides thereof and away from the ends of the strap, the force of the pins on the release plate largely cancel so that no significant side thrust on the release plate is experienced. The buoyancy of the buoy does pull on the ends of the strap and the latter does provide side thrust on the pins but a substantial biasing force on the pins ensures there is no jamming from the latter effect.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
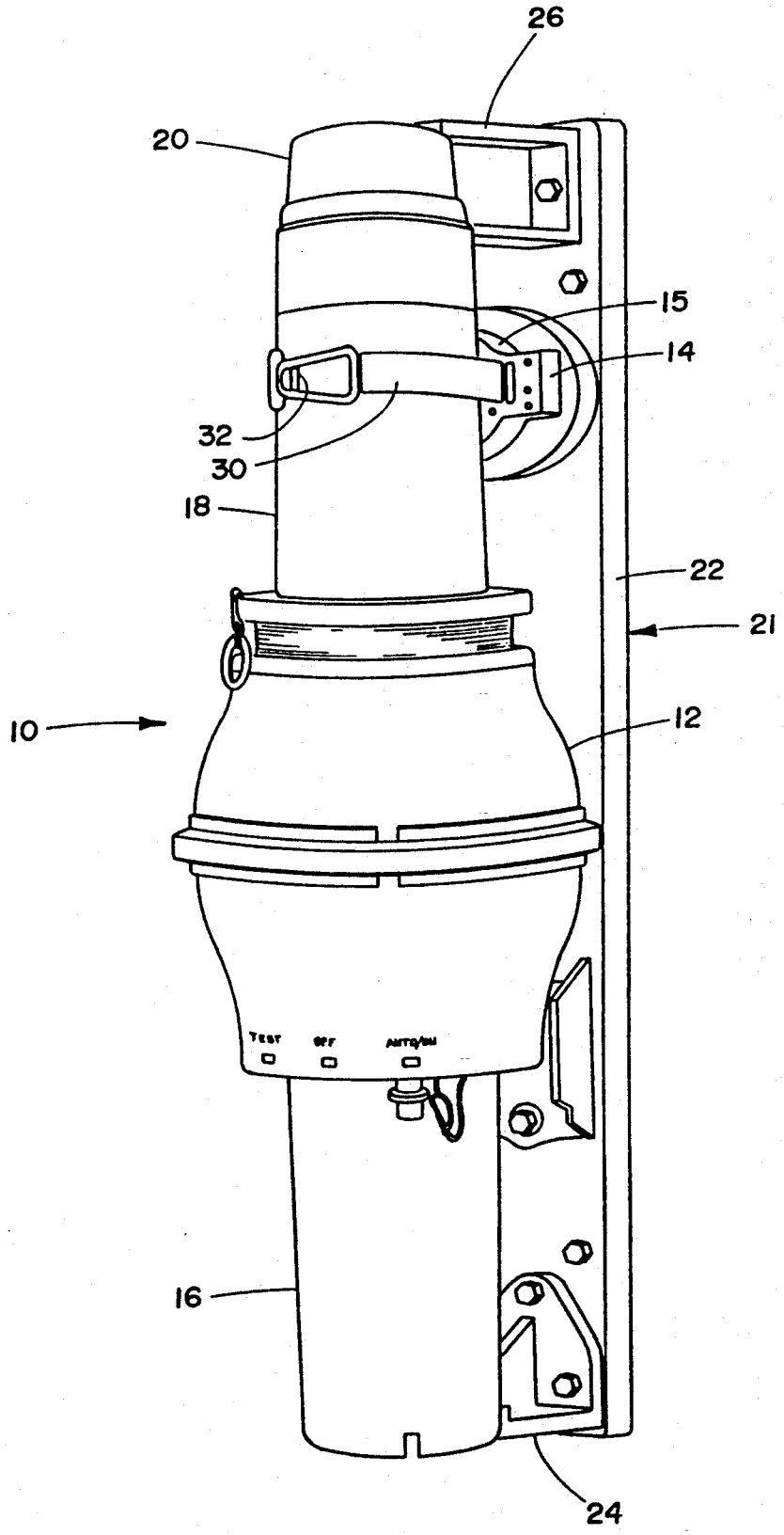
FIG. 1 is a perspective view of an emergency position indicating radio beacon shown held in a mounting bracket assembly by a strap.

Referring to FIG. 1 there is shown an emergency position indicating radio beacon buoy 10 positioned on a mounting assembly 22 consisting of a lower bracket 24 and an upper bracket 26. The buoy is a battery operated transmitter which is designed to transmit radio signals to an orbiting satellite (not shown). The satellite, in turn, relays the signals to a control centre (also not shown) which interprets the signal to determine the boat ownership, size, number of crew and location. Search and rescue forces are then dispatched. The buoy 10 has an expanded centre section 12 which houses the transmitter (not shown). An elongate lower section 16 houses the batteries (not shown) while an elongate upper section 18 houses the antenna (not shown) and strobe light 20.

Figure 2:
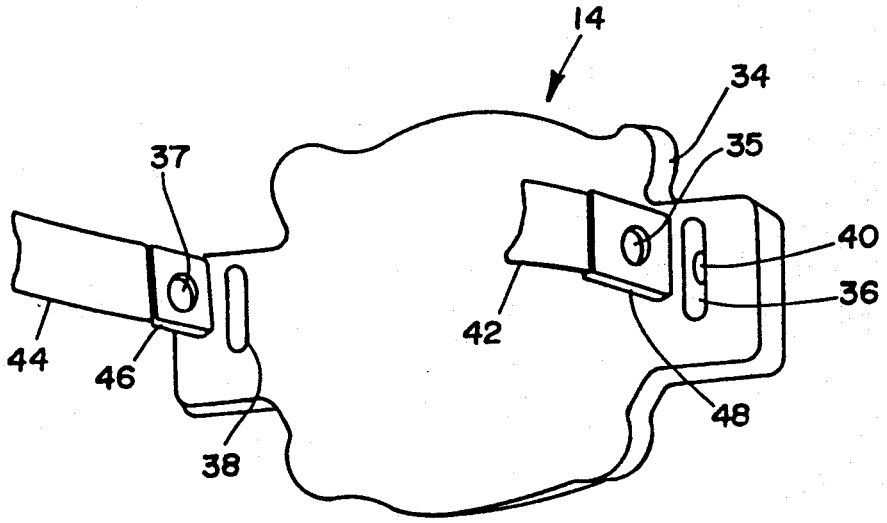
FIG. 2 is a perspective view of the release mechanism showing only the ends of the strap.

A bracket assembly 21 is made up of elongated plate 22 which attaches to a wall, floor or other support surface of a vessel (not shown). A bottom bracket 24 is affixed to plate 22 and fits under the bottom of lower section 16 while a top bracket 26 has a pair of protruding plates with arcuately shaped ends to conform to the cylindrical shape of the strobe light 20 and upper section 16 which they contact. Below the upper bracket 26 is a sensing device 15 (shown in detail in FIG. 4) and a release mechanism 14 which operates in conjunction with and is coupled to the sensing device 15. A strap 30 wraps around the upper section of the buoy 10 and has ends or bushings (see FIG. 2) 46 and 48 in which there are holes 37 and 35, respectively. The ends 46 and 48 fit into slots 38 and 40, respectively, in release mechanism 14 until the holes 37 and 35 align with cylindrical pins 50 and 40 (see FIG. 2), respectively. Pins 50 and 40 fit into holes 37 and 35 and lock the ends 46 and 48, respectively, to the release mechanism 14. The strap 30 also has a manually operated latch 32.

Figure 3:
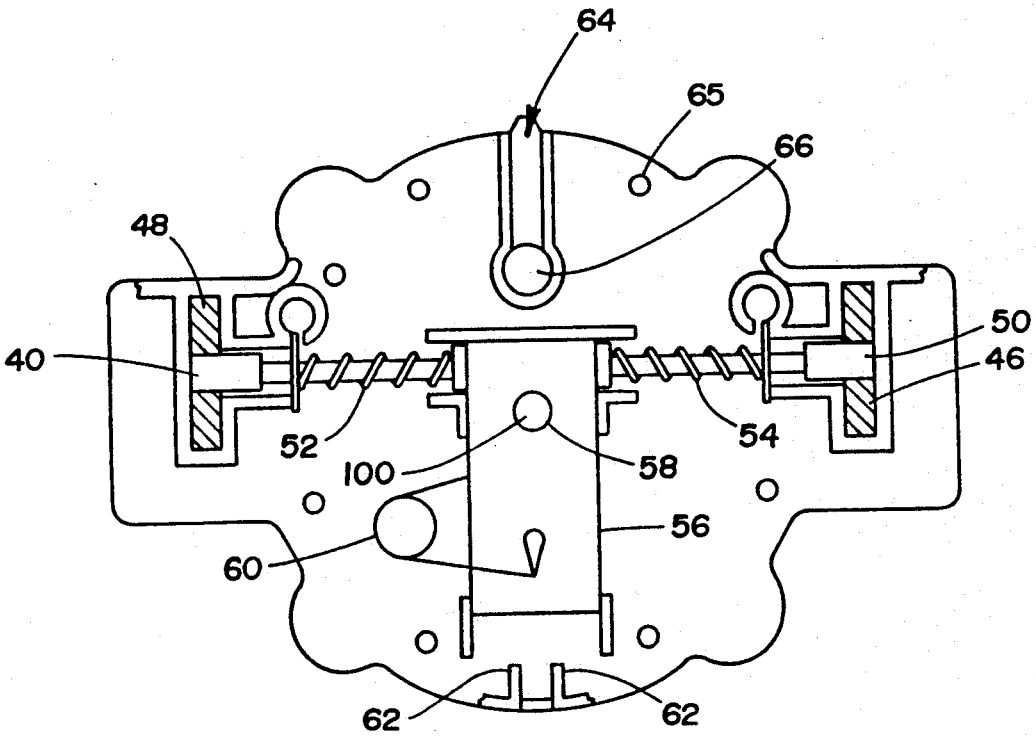
FIG. 3 is a view of the inside of the release mechanism with the strap ends in section.

FIG. 3 shows the inside of the release mechanism 14. A plate 56 is biased by a spring 60 towards stops 62. A rod hole 58 in the plate aligns with a piston rod 100 shown in FIG. 4 which is normally inserted into hole 58 holding plate 56 away from stops 62. In the latter position release plate 56 holds pins 40 and 50 in a position in which they are inserted into holes 35 and 37, respectively. Pins 40 and 50 are biased by strong springs 52 and 54, respectively, towards a retracted position away from holes 35 and 37. It will be appreciated that once piston rod 100 is pulled out of hole 58, release plate 56 moves to contact and abut stops 62. Rods 40 and 50 then move out of holes 35 and 37, respectively, releasing strap ends 48 and 46 from release mechanism 14. A passageway 64 and hole 66 allow fluid communication with the underside of the release mechanism 14.

Figure 4:
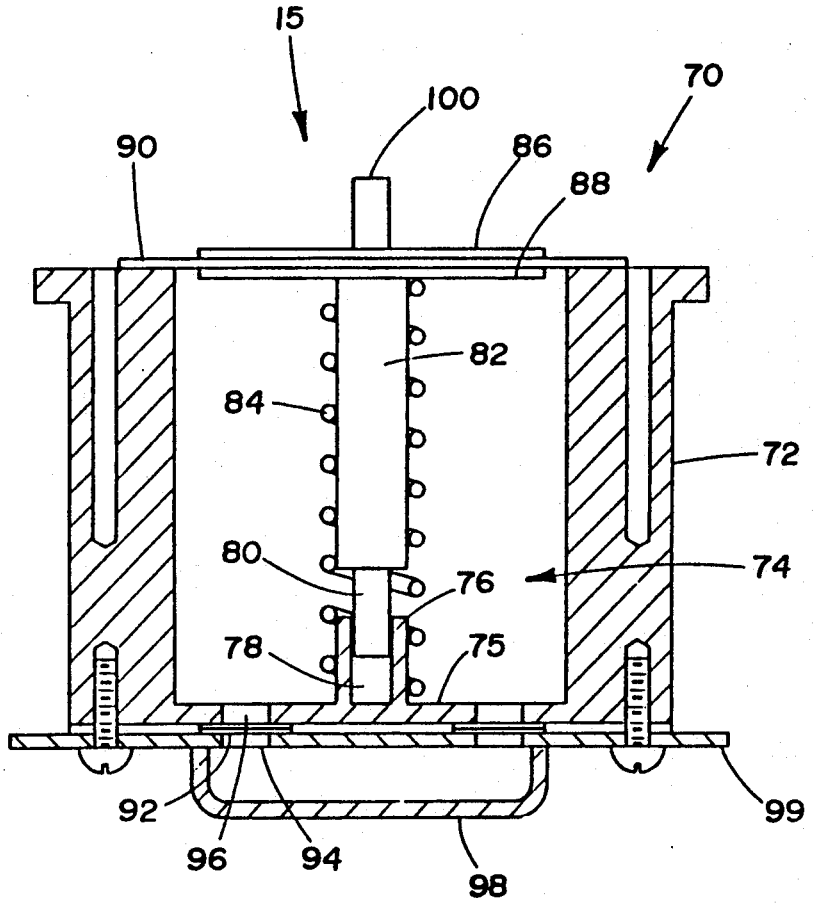
FIG. 4 is a sectional view in elevation of the sensing device used to trigger the release mechanism shown in FIGS. 2 and 3.

Referring to FIG. 4 there is shown the sensing device 15 which consists of a housing 72 that defines a chamber 74 with a closed bottom 75 and an open top end. The bottom 75 has a pair of holes 96 with a sheet of expanded polytetrafluoroethylene 92 covering the latter. The latter material is fabricated so that it will freely pass air but will block the passage of water. The polytetrafluoroethylene sheet 92 is sealed to the area around the holes 96 by a second bottom plate 99 which also has holes 94 that align with the holes 96. The open holes 92 are covered by a plate guard 98. In the centre of the bottom 75 there is protruding cylindrical sleeve 76 having a cylindrical opening 78 in the interior. A piston has a lower rod 80 which fits into the opening 78, an expanded cylindrical body 82 and an upper piston rod 100. A pair of steel discs 86 and 88 sandwich a large sheet of expanded polytetrafluoroethylene 90 which acts as a diaphragm and is sealed to the top of the housing 72.

The release mechanism 14 fits over the open end of the sensing device 15 such that upper piston rod 100 fits into hole 58 and a plurality of screws (not shown) passing through screw holes 65 in the release mechanism 14 engage aligned, threaded screw holes in the top of sensor 15 and compress the edges of diaphragm 92. A coil spring 84 enclosing body 82 and sleeve 76 biases diaphragm 90 outwardly.

Under normal circumstances piston rod 100 is inserted into hole 58 and holds release plate 56 away from stops 62 against the biasing force of spring 60. Thus, pins 40 and 50 are kept in an extended position in which they are fully inserted into holes 35 and 37 in ends 48 and 46 against the biasing forces provided by springs 52 and 54, respectively. When the pressure inside the sensor increases as, for example, when the sun suddenly comes out and raises the temperature, air freely passes through diaphragm 90 as well as through sheets 92 so as to equalize the pressure inside chamber 74 with atmospheric pressure. A similar equalization occurs when the temperature drops.

If the sensor 15 is immersed in water, as when a ship to which it is attached sinks, the water is unable to pass through diaphragm 90 or sheets 92. The water pressure is transmitted to the area above the diaphragm 90 by passage 64 and hole 66. As the sensor 15 sinks deeper, the water pressure above diaphragm 90 increases and forces down diaphragm 90 against the biasing force of spring 84. Once upper piston rod 100 has been retracted from hole 58, release plate 56 moves against stops 62 allowing pins 40 and 50 to move back out of ends 48 and 46, respectively. Thus both ends of strap 30 are freed thereby freeing buoy 10 to float to the surface. By releasing both ends of strap 30 the latter falls away from upper section 18 and releases the buoy 10. Although the release of only one end of the strap would ordinarily suffice to release the buoy the redundancy of releasing both ends prevents a failure to release one end from locking the buoy to the bracket assembly 21.

The operation of upper piston rod 100 is not affected by buoyancy of the buoy 10, being subject only to a small but constant side thrust due to the sliding release plate 56. The two release pins 40 and 50 are subject to the variable side loading due to the buoyancy of the buoy 10, but since their coaxial springs 52 and 54 are made strong enough to overcome the "jamming" effect of this side loading under all conditions, they are not affected.

The release pins 40 and 50 hold both ends of the strap 30 and upon triggering, release both ends simultaneously. Thus, if for any reason one end of the strap 30 is not released the other will still release and free the buoy 10. Moreover, with two opposed pins, the forces on the sliding release plate 56 essentially cancel allowing the release plate 56 to slide more freely in its track without generating significant side thrust.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. An emergency position indicating radio beacon locator, comprising:

(a) a buoy having a power source radio transmitter and a strobe light;

(b) a mounting bracket assembly affixable to a support surface and having buoy support couplings;

(c) a release mechanism coupled to said buoy, said mechanism having (i) a strap wrapped at least partially around the said buoy so as to hold it against said mounting bracket assembly;

(ii) engaging means for releasably engaging both ends of said strap; and (iii) means for actuating release of both ends of said strap by said engaging means in response to an increase in water pressure.

2. An emergency position indicating radio beacon locator according to claim 1, wherein the strap of said release mechanism has a hole near each end thereof and wherein said engaging means includes a pair of pins in an inserted position in the holes, whereby the ends of said strap are engaged when said pins are inserted in the holes.

3. An emergency position indicating radio beacon locator according to claim 2, including a spring-loaded release plate having a rod hole and said actuating means includes said plate and a water pressure sensor having a piston rod biased so as to be inserted into the rod hole in said release plate when engaged, and removable from the rod hole in response to an increase in water pressure beyond a predetermined level, thereby allowing said pressure release plate to slide and withdraw said pair of pins from the ends of said strap.

4. An emergency position indicating radio beacon locator according to claim 2 or 3, in which said pair of pins is aligned and movable towards each other including biasing means for biasing each of said pins away from respective ones of the holes in the ends of said straps release mechanism, wherein said engaging means is a pair of pins held in a position in which they are inserted through holes in ends of said strap, and biased away from the holes.

5. A release mechanism for a buoyant object, comprising:

(a) a strap wrapped at least partially around the object so as to hold it against a support surface;

(b) engaging means for releasably engaging both ends of said strap; and (c) means for actuating release of both ends of said strap by said engaging means in response to an increase in water pressure to a predetermined level.

6. A release mechanism according to claim 5, wherein said strap has a hole near each end thereof and wherein said engaging means includes a pair of pins insertable into respective ones of the holes and pin biasing means for biasing each of said pins away from the holes, including locking means for holding said pins in an inserted position in the holes, whereby the ends of said strap are engaged when said pins are inserted in said holes.

7. A release mechanism according to claim 6, wherein said locking means is a spring-loaded release plate slidable between a locking position, in which sides of said plate hold respective ones of said pins inserted into the holes, and a release position, in which said pins are withdrawn from the holes, and having a rod hole therein and said actuating means includes said plate and a water pressure sensor having a piston rod inserted into the rod hole in said release plate when engaged, and said rod removable from the rod hole in response to an increase in water pressure beyond a predetermined level, thereby allowing said pressure release plate to slide to the release position and permit said pair of pins to withdraw from respective holes in the ends of said strap in response to the biasing force of the pin biasing means.

8. A release mechanism for a buoyant object, comprising:

(a) a strap wrapped at least partially around the object so as to hold it against a support surface;

(b) a pair of bushings affixed to respective ends of said strap, each bushing having a hole therethrough;

(c) a pair of release pins slidably insertable into respective holes in said bushings;

(d) pin biasing means for biasing each of said pins away from respective ones of said bushings; and (e) a trigger mechanism coupled to said pins and operative in response to an increase in water pressure to initiate withdrawal of said pins from said bushings and thereby release ends of said strap.

9. A release mechanism according to claim 8, wherein said trigger mechanism includes a release plate slidable between a locking position, in which said pins are held by opposite sides of said release plate so as to be inserted through said bushings, and a release position, in which said pins are free to withdraw from the bushing holes, and plate biasing means for biasing said plate towards the release position.

10. A release mechanism according to claim 8, wherein said pins are axially aligned and biased towards each other.

11. A release mechanism according to claim 9, including a pressure sensor having a piston rod and wherein said release plate has a rod hole therein and said piston rod is movable from an extended position in which it is inserted through said rod hole so as to hold said pins inserted into the holes in respective ones of said bushings to a retracted position, in which said rod is withdrawn from said rod hole and in response to the plate biasing force said plate moves to a position in which said pins are withdrawn from the holes in said bushings.

* * * * *